US008322254B2

(12) United States Patent
Pasto

(10) Patent No.: US 8,322,254 B2
(45) Date of Patent: Dec. 4, 2012

(54) PLANK INSTALLATION TOOL WITH INFINITESIMAL JOIST WIDTH ADJUSTMENT

(75) Inventor: Cris E. Pasto, Spencer, NY (US)

(73) Assignee: Res-Q-Jack, Inc., Elmira, NY (US)

( * ) Notice: Subject to any disclaimer, the term of this patent is extended or adjusted under 35 U.S.C. 154(b) by 410 days.

(21) Appl. No.: 12/576,225

(22) Filed: Oct. 8, 2009

(65) Prior Publication Data

US 2010/0122511 A1 May 20, 2010

Related U.S. Application Data

(60) Provisional application No. 61/103,916, filed on Oct. 8, 2008.

(51) Int. Cl.
*E04F 21/20* (2006.01)
*B66F 15/00* (2006.01)

(52) U.S. Cl. ..... 81/46; 254/17

(58) Field of Classification Search ..... 81/46; 254/11, 254/15–17, 113, 120, 131, 13, 116, 119; 269/189, 240

See application file for complete search history.

(56) References Cited

U.S. PATENT DOCUMENTS

| | | | | | |
|---|---|---|---|---|---|
| 10,061 | A * | 9/1853 | Parrish | 254/13 |
| 32,120 | A * | 4/1861 | Clough | 254/15 |
| 77,610 | A * | 5/1868 | Hall | 254/17 |
| 136,428 | A * | 3/1873 | Foster | 254/12 |
| 4,449,704 | A * | 5/1984 | Goulter | 269/88 |
| 4,660,806 | A * | 4/1987 | Masters | 254/11 |
| 5,248,127 | A * | 9/1993 | Young | 254/15 |
| 5,269,494 | A * | 12/1993 | Pittman et al. | 254/17 |
| D353,987 | S | 1/1995 | Pasto | |
| 5,964,450 | A * | 10/1999 | Pasto | 254/11 |
| 2005/0247019 | A1 * | 11/2005 | Pasto | 52/749.12 |

* cited by examiner

*Primary Examiner* — David B Thomas

(74) *Attorney, Agent, or Firm* — Aquilla Patents & Marks PLLC; Thomas T. Aquilla

(57) ABSTRACT

A carpentry tool for the installation of parallel boards includes an elongated lever having a rotatable cam pivotally affixed adjacent to a distal end of the lever, a gripper body pivotally affixed at a distal end of the lever, the gripper body having two lugs or brackets extending downward from the lower end of the gripper body, wherein the gripper body includes a multi-piece telescopic section having outer and inner tubing members in slidable engagement, the one tubing member including a first lug or bracket on a lower face thereof, another tubing member including a second lug or bracket on a lower face thereof, opposing the first bracket, and a spindle extending from an upper face of the gripper body, and a mechanism for reversibly adjusting the sliding tubing members at predetermined points.

4 Claims, 5 Drawing Sheets

PLANK INSTALLATION TOOL WITH INFINITESIMAL JOIST WIDTH ADJUSTMENT

BACKGROUND OF THE INVENTION

1. Field of the Invention

The invention pertains generally to the field of carpentry tools. More particularly, the invention pertains to apparatus and methods for gripping a floor joist or wall stud and forcing abutting edges of parallel boards into contact with one another, such as during installation or repair of tongue-and-groove type flooring or other parallel boards over a frame, joist or stud.

2. Description of Related Art

Wooden flooring is usually supplied as boards having tongue-and-groove edges, such that the floor is laid over a subfloor by placing the boards next to each other, forcing the tongue on the edge of one board into the mating groove of the next, and nailing the boards in place through the edge, so that the nails are invisible when the next board is installed. Forcing the tongues into the grooves requires a fair amount of force, and the boards must be held tightly together as the nails are driven. In other applications, such as wherein no subflooring is used, parallel boards must be forced and held together prior to and during nailing.

Traditionally the installation and repair of wooden flooring and other parallel boards has required two carpenters. To assure a tight fit between the individual pieces of flooring the first carpenter forces the flooring being installed or repaired into proper position, while the second carpenter securely fastens the flooring being held to the subfloor, or fastens the parallel boards to a floor joist or wall stud, for example. To insure that the boards are held tightly together, it has generally been the case that nails are driven into the flooring, typically used at an angle, so that as the nail engages with the subfloor or joist, the individual boards are driven laterally into a tighter abutment with the board previously put in place. In this manner the flooring or wall is constructed, one piece at a time, gradually being laid from the base of a starting wall towards the base of an ending wall where the last piece will be put in place.

A number of devices have been developed in the past to aid in the installation of flooring and other parallel boards, but they have had a number of deficiencies, which make them difficult to use.

Examples of prior art flooring clamps or jacks include Parrish, "FLOOR CLAMP" U.S. Pat. No. 10,061, issued in 1853; Foster, "FLOOR-CLAMPS", U.S. Pat. No. 136,428, issued in 1873; or Lassahn, "CLAMPING DEVICE FOR CONSTRUCTING FLOORING, DECKING AND THE LIKE", issued in 1964. All of these devices force the flooring into alignment using screw (Parrish), rack-and-pinion (Foster) or hydraulic (Lassahn) force exerted against the floor joists.

Masters, "PUSH STICK FOR PLUMB AND LINE ADJUSTMENT OF STUD WALLS", U.S. Pat. No. 4,660,806, issued in 1987, is a more general pushing device using a hydraulic ram, but is not used for flooring.

Powernail Co. Inc, P.O Box 300, Lincolnshire, Ill. 60069, currently markets two models of a flooring jack called a Powerjack™. Both use a ratchet mechanism to exert force on flooring. The Powerjack 100 has a bent leg which hooks over the edge of the tongue-in-groove flooring and a flat pressor foot moved by a ratchet. The unit rides on the flooring to be moved, while the pressor foot pushes against a stationary object such as a wall or a stud nailed to the subfloor, thus pulling the flooring into place. The Powerjack 200 is designed for glue down and gym floor installation by pushing from a subfloor anchor point. It has a flat foot which must be attached by nails or screws to the subfloor, and a second foot which can be moved by a ratchet to press against the tongue-in-groove flooring. Both have relatively restricted maximum distances from their anchor points, and, unless used right next to a wall in the case of the model 100, both require some sort of anchor attached to the subfloor.

Various other tools also are known for pushing deck or flooring boards and the like into parallel contact before nailing the boards to a joist. For example, U.S. Pat. No. 5,248,127 discloses a board press comprising a dog member dimensioned and configured to grip a joist and a lever attached to one end to the dog member by a ball and socket mounting for pivoting of lever about a pivot axis P-P. The ball and socket mounting enables the pivot axis to be angularly displaced about a point on pivot axis P-P, thereby permitting the user to pivot the lever perpendicularly to the edge of a board being pressed, despite twisting of the dog member on the joist during use. A method of pressing one or more boards disposed on a joist includes using the board press and pivoting the lever in a pivot plane, which is kept perpendicular to the edge of the board, while simultaneously twisting the dog member to seat it upon the joist.

U.S. Pat. No. 5,269,494 discloses a deck and soffit board camming or pushing device for pushing boards together. The camming device weighs no more than four pounds for forcing an unsecured member into contact with a secured member, where the unsecured member may be secured with a support member. The camming device includes a support plate which carries a locking arrangement. The locking arrangement includes a pair of locking lugs and a locking lever. The device also includes a camming member having camming surfaces and an operating lever having a handle. The camming member is pivotally secured with the support plate in an eccentric fashion. In operation the support member is positioned adjacent an unsecured member and on one of the support members. The lugs are arranged to extend along opposite sides of the support member. The locking lever is rotated in one direction, which locks the support plate with the support member. Now the operating lever is rotated to move the camming member against the unsecured member, which presses it into position adjacent the secured member. Here it is secured in position with the support member.

U.S. Pat. No. 5,826,858, the complete disclosure of which is hereby incorporated herein by reference, discloses a carpentry tool for pushing flooring boards into contact on a joist, which can be operated with one hand, leaving the carpenter's other hand free for hammering. The tool includes a body member having offset clamping lugs for engaging each side of a joist. A cam lever pivotally mounted at one end of the body member is adapted to force a cam thereon into pushing contact with a flooring board supported by the joist.

U.S. Pat. No. 5,964,450, the complete disclosure of which is hereby incorporated herein by reference, discloses a flooring tool for the installation or repair of wooden tongue and groove flooring. The tool has a jack for exerting linear force, with a fixed and a movable portion. A pivoting gripper is mounted upon the movable portion, and a guide is mounted upon the fixed portion, which allows a brace such as a 2×4 board to be inserted into the guide and gripper and held in place, extending the reach and usefulness of the tool. A foot upon a push-pull rod extends downwards from the fixed portion of the jack, and pushes upon the flooring planks In a preferred embodiment, two attachment points are provided for the foot on its rod, at each end of the fixed portion, providing maximum flexibility.

U.S. Pat. No. Des. 353,987 discloses a design for a tool for installing wooden planks. The tool functions by placing the 'F'-shaped bracket, hereinafter referred to as the gripper body, which is pinned to the handle, over a floor joist or similar structure. The shorter cam member, which is also pinned to the handle, is placed adjacent the board to be pushed or straightened. When the user turns the handle into the board, the joist gripper twists and locks or binds itself to the joist, preventing it from sliding down the joist, and therefore allowing the translation of the cam to push the plank. The dimensions and shape of the joist gripper directly affect its ability to lock to the joist without slipping. A joist gripper with fixed position round shafts or legs will only lock to a particular joist width, with little tolerance for variation in joist width permitted. A slightly wider span between shafts and the gripper will slide. Too narrow a span will prevent the gripper from fitting over the joist.

The tools of the prior art have various drawbacks. Most require the carpenter to use both hands to operate the tool, while an assistant nails the boards to the supporting joist. Further, the tool of U.S. Pat. No. 5,269,494 requires the carpenter to rotate a locking lever in order to engage the tool with a floor joist, before the boards can be pushed into place. Most are undesirably complex and expensive. A need exists in the art for a simple, inexpensive tool for the installation of parallel boards that can be operated with one hand and provides means for adjusting to different size joists or studs.

SUMMARY OF THE INVENTION

The present invention provides methods and apparatus for the installation of parallel boards, which can be operated with one hand and provides means for adjusting to different size joists or studs. According to a preferred aspect of the present invention, herein is disclosed a carpentry tool for the installation of parallel boards including an elongated lever having a rotatable cam pivotally affixed adjacent to a distal end of the lever, a gripper body pivotally affixed at a distal end of the lever, the gripper body having two lugs or brackets extending downward from the lower end of the gripper body, wherein the gripper body includes a two-piece telescopic section having an outer tubing member and an inner tubing member in slidable engagement, the inner tubing member including a first lug or bracket on a lower face thereof, the outer tubing member including a second lug or bracket on a lower face thereof, opposing the first bracket, and a spindle extending from an upper face thereof, and a mechanism for reversibly adjusting the sliding inner and outer tubing members at predetermined points.

According to a preferred aspect of the present invention, herein is disclosed an adjustable joist gripper, including a two-piece telescopic section having an outer tubing member and an inner tubing member in slidable engagement, the inner tubing member including a first lug or bracket on a lower face thereof, the outer tubing member including a second lug or bracket on a lower face thereof, opposing said first bracket, and means for reversibly adjusting the sliding inner and outer tubing members at predetermined points.

According to another preferred aspect of the present invention, herein is disclosed an adjustable joist gripper, including a three-piece telescopic section having first and second outer tubing members and a center inner tubing member in slidable engagement, the first outer tubing member comprising a first spindle or lug on a lower face thereof and the second outer tubing member comprising a second spindle or lug on a lower face thereof, opposing the first lug. In the preferred embodiment, means for reversibly adjusting the sliding tubing members includes a threaded adjusting rod passing concentrically through the outer and inner tubing members, which engages a corresponding thread in the inner tubing member, and/or reversing orientation of the second outer tubing member with respect to the inner tubing member.

An advantage of the present invention is that it provides a tool for pushing or pulling parallel boards together, as the cam and gripper positions are interchangeable. Furthermore, the invention is suitable for use with a variety of differently sized joists or studs. Another desirable feature is self-holding (set, swing, let go). Also desirable is the tool action, where the cam slides into the edge of the board in a plane that is parallel with the board surface, which allows for specialized cams that will mate with the edge profile as with tongue and groove. These and other features and advantages will become readily apparent from the following Detailed Description, which should be read in conjunction with the accompanying drawings.

BRIEF DESCRIPTION OF THE DRAWING

The drawing figures are not necessarily to scale, with the emphasis instead placed upon the principles of the present invention. Additionally, each of the embodiments depicted are but one of a number of arrangements possible utilizing the fundamental concepts of the present invention. The drawings are briefly described as follows.

DETAILED DESCRIPTION OF THE INVENTION

The following description relates to certain preferred embodiments of an infinitesimally adjustable universal joist gripper. It is understood that numerous variations and modifications, other than those specifically indicated herein, will be readily apparent to those of sufficient skill in the art. In addition, certain terms are used throughout the discussion in order to provide a convenient frame of reference with regard to the accompanying drawings, such as "upper", "lower", "top", "bottom", "side", and the like. Such terms are not intended to be specifically limiting of the invention, except where so indicated in the claims. Obviously, numerous modifications and variations of the present invention are possible in light of the teachings herein. It is therefore understood that within the scope of the appended claims, the invention may be practiced otherwise than as specifically described herein.

The present invention provides a novel tool as a useful and convenient means for pushing boards together when building decks or, for example, installing sub-flooring over joists. It can also be used for pushing plywood sheets tightly together, such as for house framing and underlayments for roofs and for other purposes.

The boards, plywood or other materials, do not necessarily have to be 90 degrees to the supporting joist, when they are being pushed by this tool. Any divergent angle of overlay over a joist, stringer or stud can be accommodated.

Figure 1:
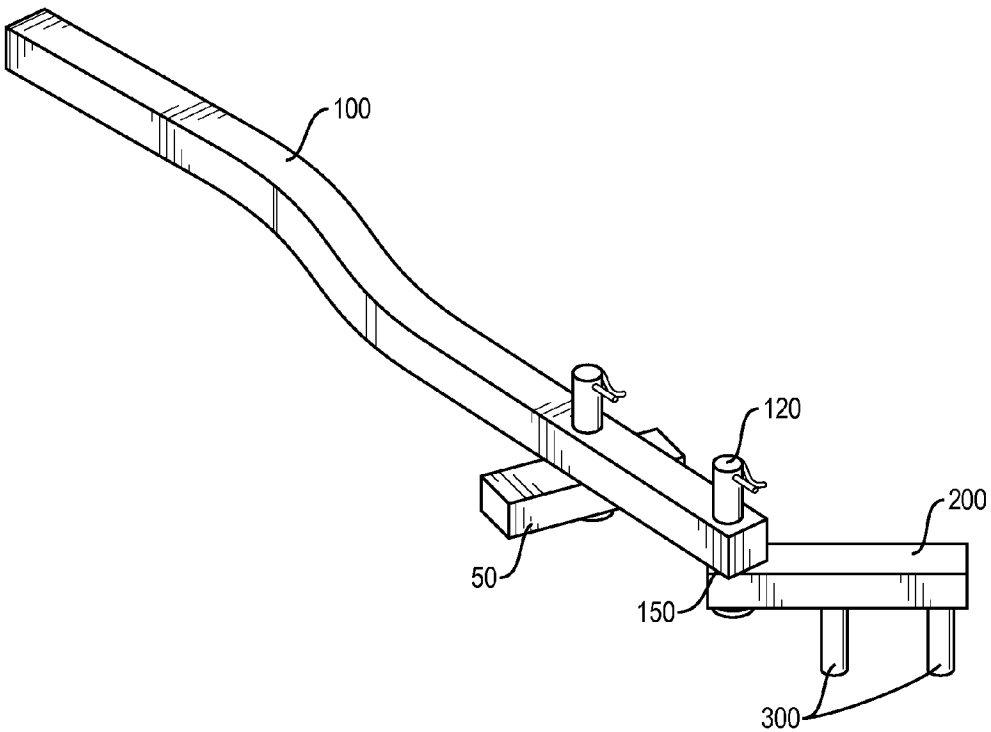
FIG. 1 (PRIOR ART)
FIG. 1 shows a prior art device for the installation of parallel boards.

As shown in FIG. 1, a tool for installing parallel boards by pushing them together is known to include an elongated lever (100) having a rotatable cam (50) pivotally affixed adjacent to a distal end of the lever for pushing the parallel boards, and a gripper body (200) having two lugs (300) for gripping a joist or stud, extending downward from the lower end of the gripper body. For example, the lugs (300) straddle a joist (not shown), which provides support to the tool. The cam (50) is aligned with the board to be pushed and the lever is actuated, pulling on the joist and pushing the board into place. The cam optionally is a flat bar or tube, or may have a profile that mates with tongue and groove boards.

Construction lumber for framing houses and decks, and a multitude of other things, generally runs in thickness from 1 7/16" to 1 3/4" thick. In the U.S. the typical maximum joist width is 1 5/8". The two lugs, when dropped over the thickness section of a joist, will accommodate these common dimensions and others. This is accomplished by virtue of the separation of the two lugs. If canted at an angle, the lugs are, for example, farther apart and can accommodate wider widths of lumber.

All joists, studs, or similar framing members are not the same width. It is therefore desirable to have a built-in adjustment feature for the joist gripper to allow for variations in joist width. Several such grippers are known, each including one stationary leg and one leg that is movable relative thereto. One such gripper includes a movable leg slidably attached to the stationary leg, with an adjustment screw passing through the top of each leg, perpendicular to the legs. One problem associated with this design is complexity in manufacturing and thus cost. A variation of this design replaces the threaded rod or screw with a locating pin, where the leg may be incrementally adjustable. This model decreases the cost only slightly, and versatility is lost, as infinitesimal adjustment is gone. Another far simpler design involves the use of a fixed leg attached to a round pipe. The adjustable leg is typically of a pipe-clamp tail-stop, which has a spring-activated locking mechanism. However, due to the nature of the pushing and rotational forces acting on the tail-stop, slipping can occur. Pipe clamps utilize round tubing; they are designed to withstand loads parallel to the pipe, not rotational loads, hence the slippage potential.

Adjustable joist grippers are herein disclosed. One embodiment is similar to the common pipe clamp described above. However, this embodiment includes means for resisting rotation of the tail-stop, which is what leads to the slippage. This is accomplished by altering the shape of the pipe. For example, a square tube or other non-round pipe or similar member would not permit rotation of an object that is slidably attached, assuming the fit between the two is close enough.

Another embodiment includes a fixed leg rigidly attached to a square or other shaped member. A second leg is slidably attached to the square member. The slidable leg is not permitted to twist. The adjustment for joist width is accomplished by pinning the slidable leg assembly at the desired location. Note that such means for attaching only allows for incremental adjustment. To overcome this problem, the shape of the legs is altered from the round shape to allow for greater width variation at each adjustment location, to achieve a sufficient lock on the joist. In a preferred embodiment, the slidable leg is a wide surface running dominantly parallel to the joist or other shape producing similar width. The wide leg allows for a wider variation in joist width to achieve a locking affect at any given pinned adjustment location. The fixed leg is similarly shaped. An alternate shape of either leg or both legs would have a cutout or void near the upper portion of the leg adjacent the attached member to allow for use over an under deck fastening track (such as, for example, products known as Deckmaster or Shadoetrack). In a preferred embodiment, the slidable leg is a piece of angle whose lengthwise axis extends downward from the engaged member. This shape gives the same effective face width parallel to the joist, along with the strength or stiffness of a larger square or other similar shape, without the bulk or weight. The fixed leg is constructed of a round or similar leg extending axially down from the attached member. A flat plate is rigidly fixed to the bottom end of this leg and extends toward the joist with the forward protruding edge running parallel to the joist. This design creates the void to allow for use with the underdeck fastening tracks described above. The adjustable leg is shorter than the fixed leg, which allows for quicker application over joists with the underdeck fastening tracks, without readjusting slidable leg. Means for attaching the adjustable gripper to the deck tool handle includes a clevis pin or the like. Similarly, the handle is pivotally captured to the gripper spindle with a cotter pin.

Figure 2:
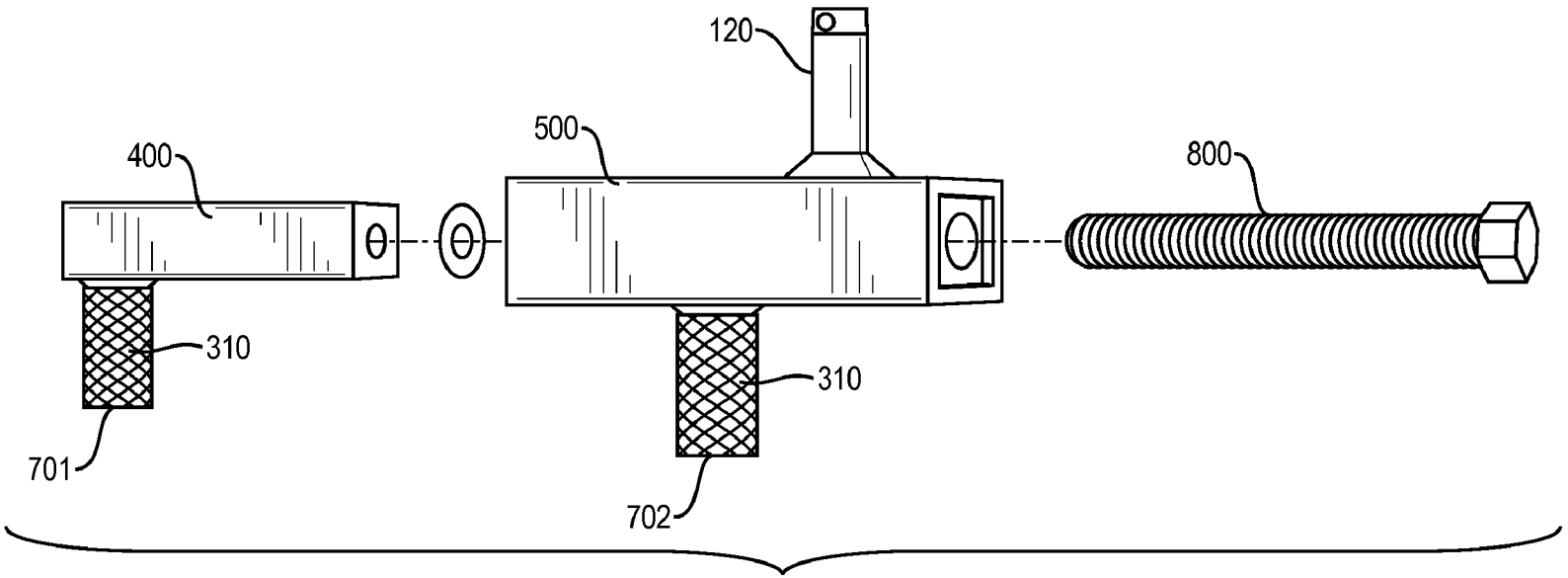
FIG. 2 shows an exploded view of an adjustable joist gripper, in accordance with an embodiment of the present invention.
Figure 3A:
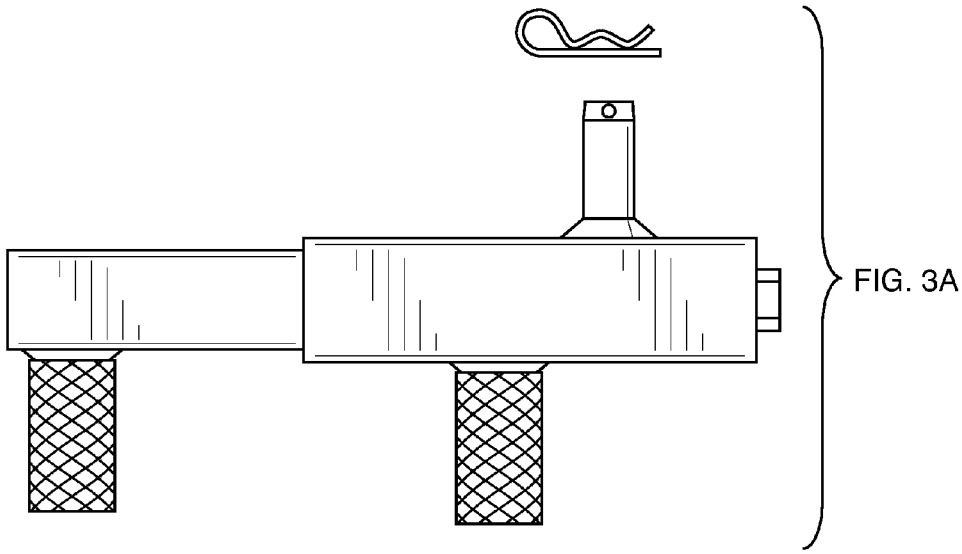
FIGS. 3*a* and 3*b* show alternate views of an adjustable joist gripper, in accordance with an embodiment of the present invention.
Figure 3B:
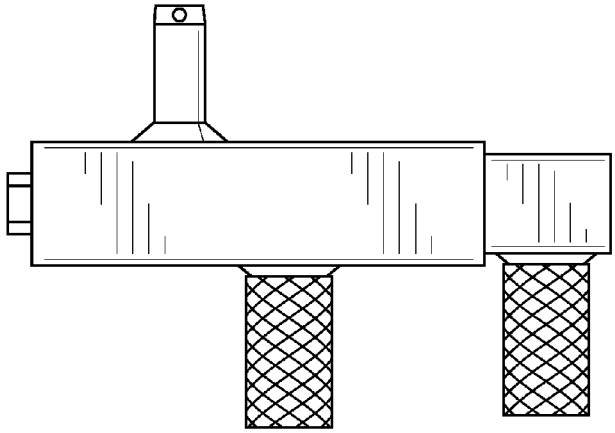
Figure 4A:
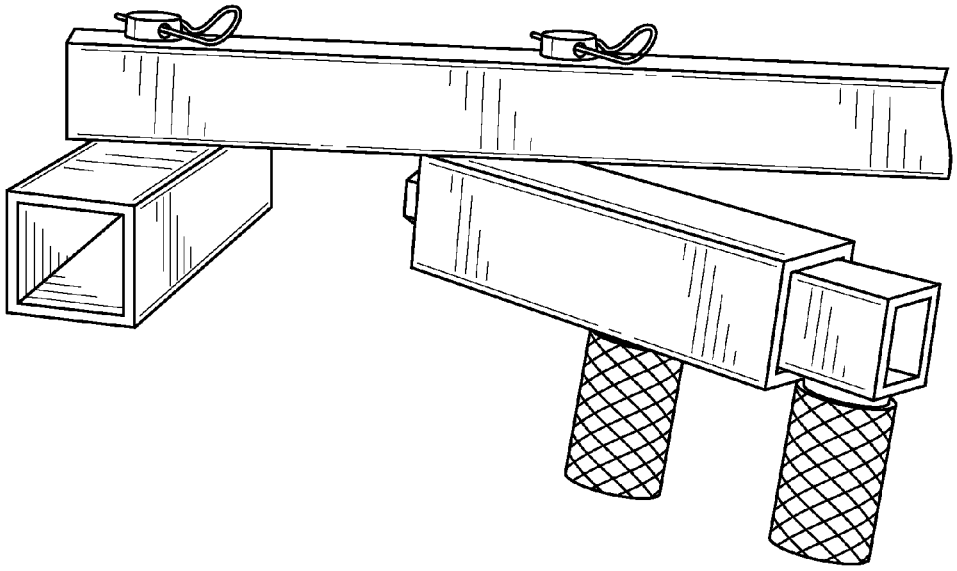
FIGS. 4*a* and 4*b* show alternate views of a decking, plywood and paneling installation tool having an adjustable joist gripper, in accordance with an embodiment of the present invention.
Figure 4B:
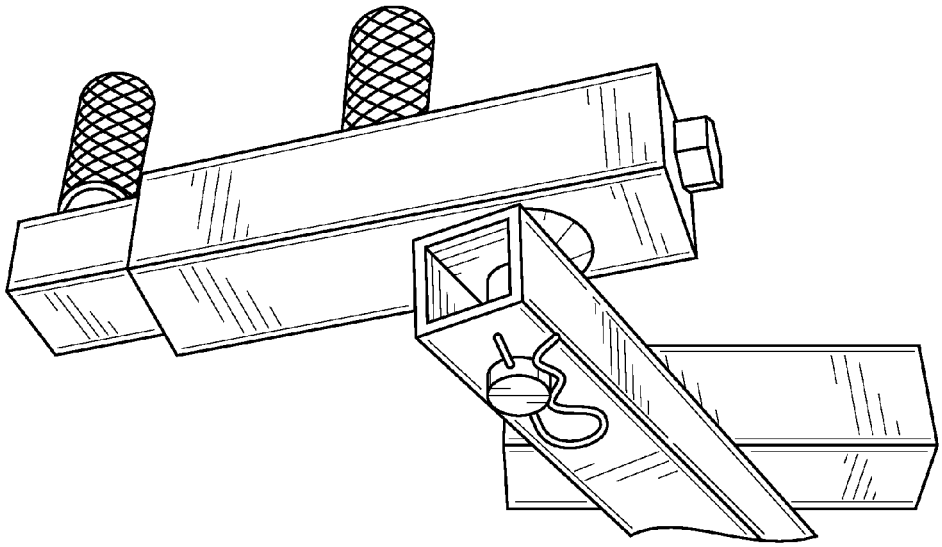
Figure 5A:
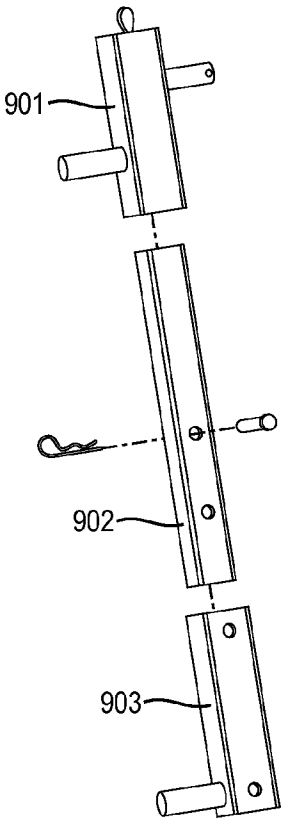
FIG. 5 shows an exploded view of an adjustable joist gripper and the size ranges achieved, in accordance with alternative embodiment of the present invention.
Figure 5B:
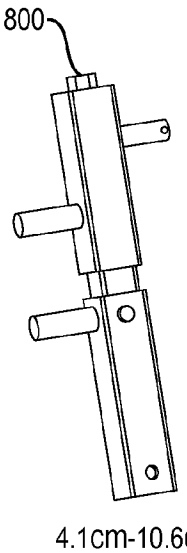
Figure 5C:
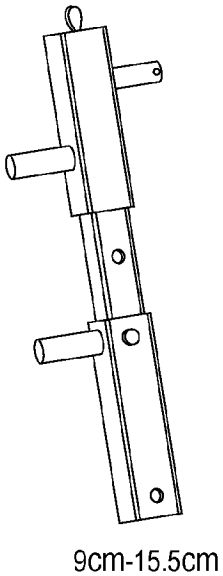
Figure 5D:
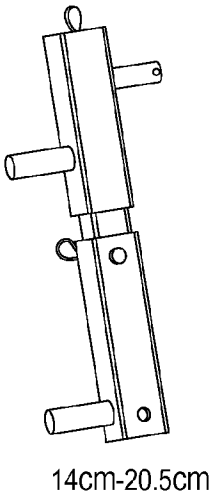
Figure 5E:
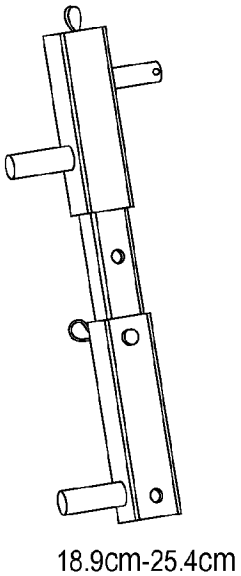

Referring now to FIGS. 2, 3*a* and 3*b*, an infinitesimally adjustable joist gripper in accordance with the invention is shown. The preferred embodiment (FIGS. 3*a* and 3*b*) includes a two-piece telescopic section having an outer tubing member (500) and an inner tubing member (400) in slidable engagement, the inner tubing member including a first lug (701) on a lower face thereof, the outer tubing member including a second lug (702) on a lower face thereof, opposing said first lug, and means for reversibly affixing the sliding inner and outer tubing members at predetermined points (adjusting rod, 800). The adjustable gripper further includes a pivot means (120) for attachment to a tool handle. Optionally, rubber tubing (310) is fitted over the lower lugs, as a protection from joist damage and also as a means for creating a better grip.

In a preferred embodiment, the means for reversibly affixing the sliding inner and outer tubing members at predetermined points includes a threaded adjustment rod, that allows for infinitesimal adjustment to fit any joist size within range of travel. For example, one embodiment is set up to capture joist widths from 1.5" to 3.5"+/−. The threaded rod passes through a clearance hole in the outer tube and through a mating threaded end cap in the end of the inner tube. Adjustment of the distance between opposing lower lugs occurs when the user rotates the end or head of the threaded rod, which in turns causes translation of the inner tube. The distance between lugs should be set to the width of the joist or stud plus an additional 1/16" to allow for ease in application and removal from the joist. The device optionally includes a travel stop at maximum width range, however, alternatively in order that the device may be taken apart, the stops are eliminated. Taking apart allows for insertion of a longer tail-piece to allow for wider joist widths (minimum width would also be impacted). Optionally, a special tailpiece is inserted to allow compatibility with track-type fasteners. Preferably, rubber hoses are fitted on the pins to protect the joists from damage. The threaded rod may or may not have a shoulder just inside the outer tube endplate, which will keep the rod from any horizontal travel relative to the outer tube—it will only allow rotation through a clearance hole within the outer tube end cap. Note that an optional spring over the threaded rod between the outer tube end cap and the inner tube end cap may also accomplish goal of shoulder mentioned above. In the absence of these internal stops, the maximum range will be restricted, but the inner tube can freely slide back to the minimum range, which could be annoying, but would not prevent function. The tool optionally sets up in a push or pull configuration, as the adjustable gripper and cam positions on the handle are interchangeable.

Referring now to FIG. 5, an alternative embodiment of an infinitesimally adjustable joist gripper in accordance with the invention is shown. The preferred embodiment (FIG. 5) includes a three-piece telescopic section having a first outer tubing member (901), a center inner tubing member (902) and a second outer tubing member (903) in slidable engagement. The first outer tubing member (901) includes a spindle on the upper face for connecting to the lever, and a first lug on the lower face thereof. The second outer tubing member (903) includes the second lug on the lower face thereof, opposing the first lug. The preferred means for reversibly adjusting the sliding inner and outer tubing members at predetermined points includes the adjusting rod (800), which passes through the first outer tubing member and attaches to a threaded fitting located within the inner tubing member. This arrangement allows the adjusting rod to adjust the distance between the first outer tube and the inner tube members. The adjusting means further includes a pair of holes through the center inner tubing member and a pair of holes in the ends of the second outer tubing member. By reversing the orientation of the second outer tubing member and/or pinning the members together through the various combinations of aligned holes, a wide range of joist sizes can be accommodated, as shown in FIG. 5.

It is to be understood that the architectural and operational embodiments described herein are exemplary of a plurality of possible arrangements to provide the same (or equivalent) general features, characteristics, and general system operation. Therefore, while there have been described the currently preferred embodiments of the present invention, those skilled in the art will recognize that other and further modifications may be made, without departing from the spirit of the present invention, and it is intended to claim all modifications and variations as fall within the scope of the appended claims. Accordingly, it must further be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A carpentry tool for the installation of parallel boards, comprising:

an elongated lever having a rotatable cam pivotally affixed adjacent to a distal end of the lever;

a gripper body pivotally affixed at a distal end of the lever by a spindle extending from an upper face of the gripper body, the gripper body comprising at least one outer tubing member and one inner tubing member in slidable engagement, and a pair of spindles or lugs extending from a lower face of the gripper body; and means for reversibly adjusting the sliding inner and outer tubing members at predetermined points;

wherein the gripper body comprises a three-piece telescopic section having first and second outer tubing members and a center inner tubing member in slidable engagement, the first outer tubing member comprising a first spindle or lug on a lower face thereof and the second outer tubing member comprising a second spindle or lug on a lower face thereof, opposing the first lug.

2. The carpentry tool of claim 1, further comprising a coating, elastic tubing or rubber fitted over the first and second opposing spindles or lugs extending from the lower face of the gripper body.

3. The carpentry tool of claim 1, wherein the means for reversibly adjusting the sliding tubing members comprises:

a) a threaded adjusting rod passing concentrically through the outer and inner tubing members, which engages a corresponding thread in the inner tubing member; and/or b) reversing orientation of the second outer tubing member with respect to the inner tubing member.

4. The carpentry tool of claim 3, wherein the reversibly adjusting means provide infinitesimal adjustment of the gap between the first and second spindles or lugs extending from the lower face of the gripper body.

* * * * *